US006390956B1

(12) United States Patent
Seelye et al.

(10) Patent No.: US 6,390,956 B1
(45) Date of Patent: May 21, 2002

(54) ADJUSTABLE SPRING RATE POGO STICK

(75) Inventors: Daniel R. Seelye, Royal Oak; John Hoss, Stevensville; Jeremy L. Iford, Zeeland; Mitchel J. Keil, Mattawan, all of MI (US)

(73) Assignee: Thomas J. VanderHorst, Kalamazoo, MI (US)

( * ) Notice: Subject to any disclaimer, the term of this patent is extended or adjusted under 35 U.S.C. 154(b) by 0 days.

(21) Appl. No.: 09/540,120

(22) Filed: Mar. 31, 2000

(51) Int. Cl.[7] ..... A63B 25/08
(52) U.S. Cl. ..... 482/77; 482/128
(58) Field of Search ..... 482/75–77, 26, 482/15, 128, 121, 908; 472/131, 135, 14; 446/486; D21/412–413

(56) References Cited

U.S. PATENT DOCUMENTS

| | | | | | |
|---|---|---|---|---|---|
| 2,793,036 | A | * | 5/1957 | Hansburg | 272/57 |
| 2,871,016 | A | | 1/1959 | Rapaport | |
| 2,929,459 | A | | 3/1960 | Spitzmesser | |
| 3,074,715 | A | | 1/1963 | Taylor | |
| 3,181,862 | A | | 5/1965 | White | |
| 3,427,019 | A | | 2/1969 | Brown | |
| D215,552 | S | | 10/1969 | Rieth | |
| 3,633,908 | A | * | 1/1972 | Krauth | |
| 3,773,320 | A | | 11/1973 | Samiran et al. | |
| 3,869,120 | A | * | 3/1975 | Nissen | 272/65 |
| 4,239,212 | A | * | 12/1980 | Hickey | 272/141 |
| 4,390,178 | A | | 6/1983 | Rudell et al. | |
| 4,865,317 | A | * | 9/1989 | Hickey | 272/141 |
| 4,927,137 | A | * | 5/1990 | Speer | 272/70.1 |
| D316,280 | S | | 4/1991 | White | |
| 5,087,037 | A | | 2/1992 | Morrow | |
| 5,292,295 | A | * | 3/1994 | Gerlach | 482/77 |
| 5,713,819 | A | | 2/1998 | Hsieh | |

OTHER PUBLICATIONS

Spring Design Manual, Second Edition, Chapter 5, Design of Helical Springs, pp. 189–191, by Society of Automotive Engineers, Inc., 1996.

Mechanical Engineering Design, Fifth Edition, Chapter 10, Mechanical Springs, pp. 413–416, by Joseph Shigley et al.

Design and Application of Helical and Spiral Springs, Chapter 5, Design of Helical Springs, p. 57, by Society of Automotive Engineers, Inc. 1980.

* cited by examiner

*Primary Examiner*—Denise Pothier
(74) *Attorney, Agent, or Firm*—Flynn, Thiel, Boutell & Tanis, P.C.

(57) ABSTRACT

An adjustable spring rate pogo stick that incorporates two springs, with different spring rates, in parallel. This two-spring system can produce three different spring rates by allowing the user to engage one spring (first setting), the other spring (second setting) or both springs simultaneously (third setting). This pogo stick will accommodate weights of below 80 pounds to above 250 pounds.

9 Claims, 3 Drawing Sheets

ADJUSTABLE SPRING RATE POGO STICK

BACKGROUND OF THE INVENTION

1. Field of the Invention

The present invention relates to a pogo stick with springs having multiple spring rates.

2. Description of Prior Art

Pogo sticks are well-known recreational toys that have been in existence for many years. The pogo stick generally comprises an upper member, which is tubular, having a hand graspable portion at the upper end and having foot-engaging portions at the lower end. Telescopically and slidably fitted into the lower end of the upper member is a lower member having a ground-engaging element at the lower end and with a spring being provided acting axially between the tubular members. Examples of such pogo sticks are described in U.S. Pat. Nos. 2,871,016, 2,929,459, 3,074,715, 3,181,862, 3,427,019, 3,773,320, 4,390,178, 5,087,037, 5,713,819, and shown in U.S. Design Patents 215,552 and 316,280. While these patents describe a variety of pogo sticks, we have found no such devices capable of accommodating weights of 80 to 250 pounds.

Pogo sticks incorporating multiple springs in parallel are known. Two of the patents referred to above, U.S. Pat. Nos. 3,427,019 and 5,713,819, disclose such pogo sticks. However, neither of the pogo sticks described therein utilize springs that have different spring rates.

Pogo sticks having an adjustable spring bias that makes the device more adaptable to individuals of different weights are described in U.S. Pat. Nos. 2,929,459 and 3,733,320. However, the means for adjusting the spring bias does not include multiple springs having different spring rates.

Previously, there was not a pogo stick available that could handle a wide range of weights effectively. The maximum weight range prior to this design was found to be about 80 to 180 pounds. Although this prior art pogo stick was rated to handle this weight range, it was found to be somewhat ineffective. When a lighter person used the pogo stick, the spring would not reach its maximum displacement. On the other hand, a heavier person would reach maximum displacement too easily, thus bottoming out the pogo stick. As stated above, the maximum weight of the user was restricted to 180 pounds. To address these issues, a pogo stick needed to be designed to have an adjustable weight range and to extend the usable maximum weight to 250 pounds and above.

BRIEF SUMMARY OF THE INVENTION

Therefore, it is the primary objective of the present invention to provide a pogo stick that will accommodate a wide range of weights. This objective is attained by an adjustable spring rate pogo stick that incorporates multiple springs with different spring rates in parallel.

In one embodiment, the multiple spring system can produce three different spring rates. The design of this new spring engagement mechanism allows the user to engage one spring (first setting), the other spring (second setting) or both springs simultaneously (third setting). While existing pogo sticks only accommodate weights up to 190 pounds, a preferred pogo stick of the present invention will accommodate weights of about 80 pounds to about 250 pounds.

Another objective is to provide a pogo stick with discrete spring rates achieved by selectively engaging one spring alone or multiple springs.

Another objective of the invention is to provide a pogo stick that can be used for activities such as aerobic workouts, balancing, balance conditioning for athletes, stunts and tricks and family fun.

Another objective of the invention is to provide a pogo stick that can be adjusted to accommodate users of widely different body weights and yet that is light enough to be used effectively.

And yet another objective of the invention is to provide a pogo stick wherein the springs are covered by a safety shield or sleeve to prevent injury in the event of failure.

The foregoing objectives of the present invention are attained by an improved pogo stick, which comprises:

a) a top brace;
b) a handle fastened to the top brace;
c) a bottom brace;
d) frame members that form a part of said handle and that are fastened to the top and bottom braces;
e) an elastic member that consists of multiple compression springs having different spring rates and that slidably surround the frame members and are compressible between the top brace and the bottom brace;
f) a center shaft that is parallel to the frame members and in slidable relationship to said top and bottom braces; and
g) engagement means that are in communication with the end of the springs nearest the bottom brace and that selectively allows only one or multiple springs to be compressed simultaneously, thereby providing three or more different spring settings.

In a preferred embodiment, the foregoing objectives of the present invention are attained by an improved pogo stick, which comprises:

a) a top brace;
b) a handle fastened to the top brace;
c) a bottom brace;
d) a pair of frame members that form a part of said handle and that are fastened to the top and bottom braces;
e) an elastic member that consists of first and second compression springs having different spring rates and that slidably surround the frame members and are compressible between the top brace and the bottom brace;
f) a center shaft that is parallel to the frame members and in slidable relationship to said top and bottom braces; and
g) engagement means that are in communication with the end of the springs nearest the bottom brace and that selectively allows only the first spring or the second spring or both of them to be compressed simultaneously, there by providing three different spring settings.

REFERENCE NUMERALS IN DRAWINGS

Figure 1:
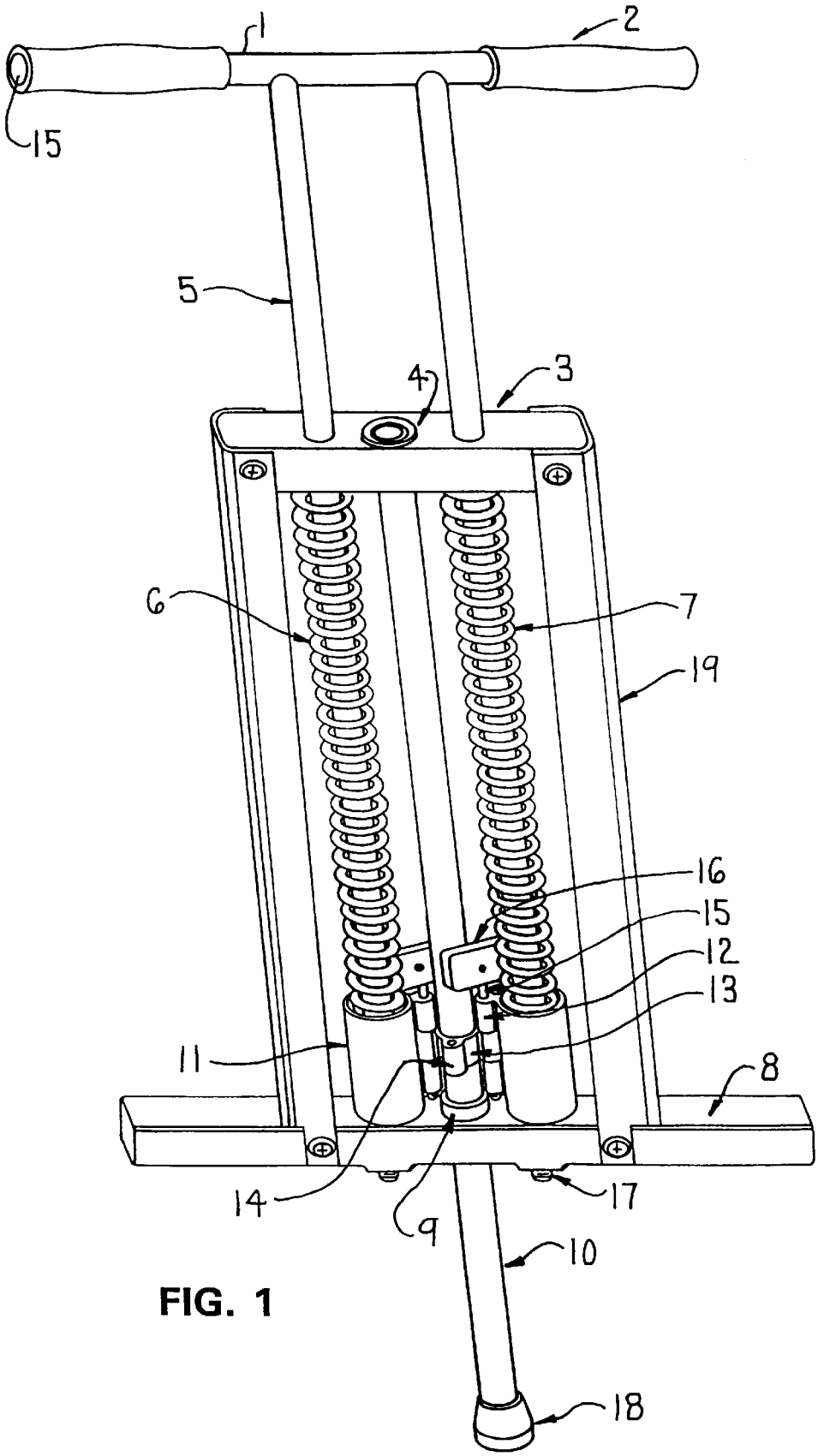
FIG. 1 shows a perspective view of an embodiment of the present invention.

1. handle bars
2. handle grip
3. top brace
4. top brace bushing
5. frame member
6. spring $k_1$
7. spring $k_2$
8. bottom brace
9. bushing for bottom brace
10. center shaft
11. engagement cup
12. engagement cup sleeve
13. center ring
14. center ring sleeve
15. engagement pin
16. engagement pin handle
17. bottom plug
18. dampening tip
19. safety sleeve

DETAILED DESCRIPTION OF THE INVENTION

Figure 2:
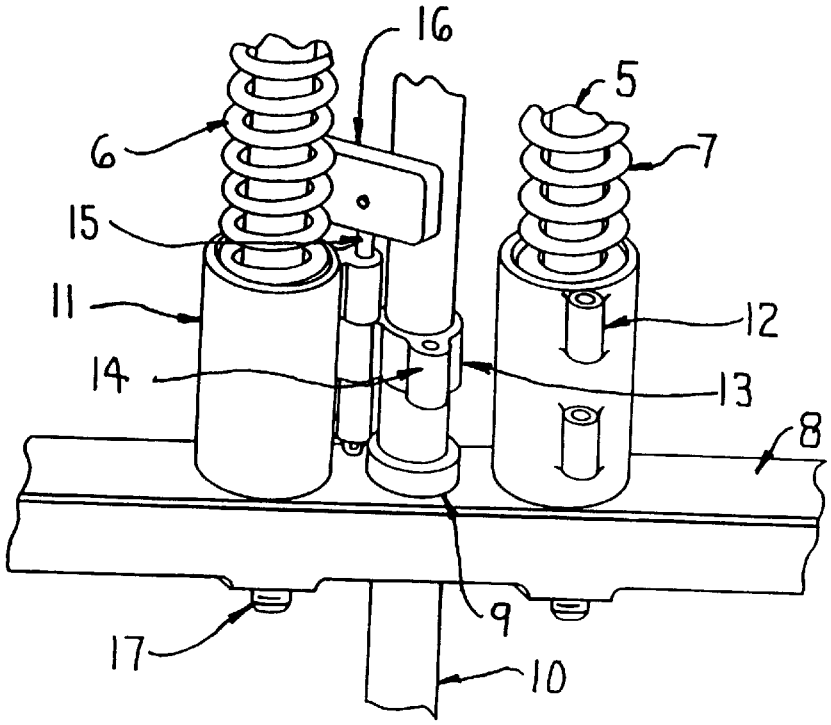
FIG. 2 shows a perspective view of an embodiment of the engagement mechanism in position to handle the lighter weight (first setting).
Figure 3:
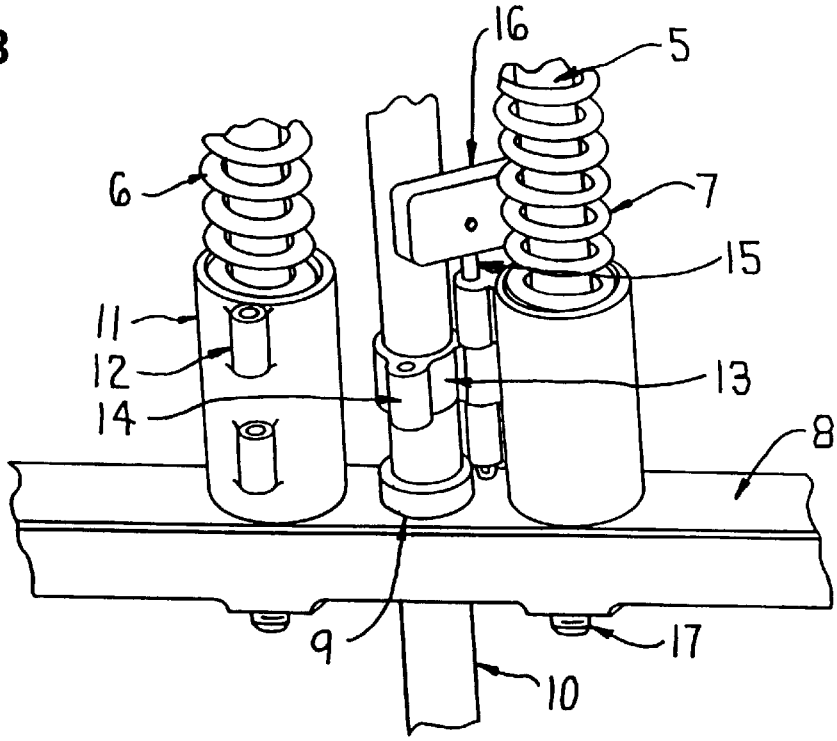
FIG. 3 shows a perspective view of an embodiment of the engagement mechanism in position to handle medium weight (second setting).
Figure 4:
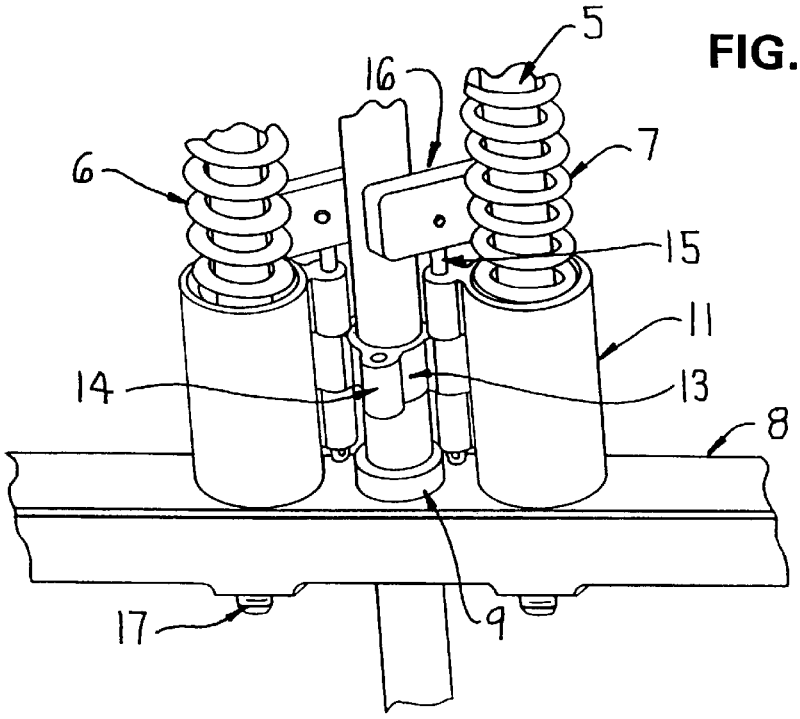
FIG. 4 shows a perspective view of an embodiment of the engagement mechanism in a position to handle the maximum weight (third setting).
Figure 5:
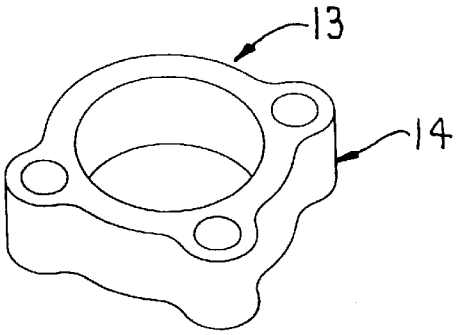
FIG. 5 shows a perspective view of an embodiment of the center ring.
Figure 6:
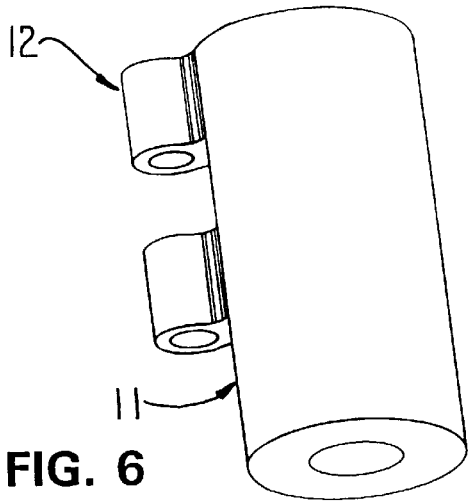
FIG. 6 shows a perspective view of an embodiment of the engagement cups.
Figure 7:
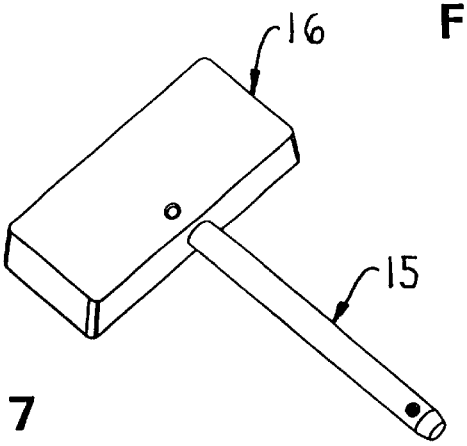
FIG. 7 shows a perspective view of an embodiment of the engagement pin.
Figure 8:
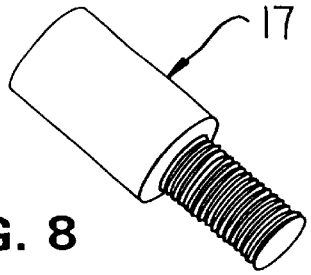
FIG. 8 shows a perspective view of an embodiment of the bottom plug.

As shown in FIGS. 1–8, an embodiment of the present invention comprises a handle bar 1, a top brace 3, a bottom brace 8, which also serves as a footrest, a pair of frame members 5 that are perpendicular to and attached to handle bar 1, top brace 3 and bottom brace 8, an elastic member that consists of a pair of coiled springs 6 and 7 having different spring rates $k_1$ and $k_2$ and that axially and slidably surround the frame members 5 and are compressible between the top brace 3 and the bottom brace 8.

A center shaft 10 is parallel to the frame members 5 and in a slidable relationship with the top brace 3 and bottom brace 8. Engagement means that selectively allow one spring 6 or the other spring 7 or both of them to engage simultaneously.

The handle is made up of handle bar 1 and the portions of the frame members 5 that are above the top brace 3. Hand grips 2 are fitted on the handlebars and end caps 15 are fitted into the ends of the handle bars.

The top brace 3 is permanently fastened to the frame members 5 and is provided with an opening in the center containing a bushing 4.

The spring means are compression helical coil springs made of any suitable spring means for pogo sticks. Different materials available for such springs are well known in the prior art. (Warrendale, P. A. "Spring Design Manual", Second Edition, Society of Automotive Engineers, 1996). One such material is music wire, which has high tensile strength and the ability to withstand higher stresses under repeated loading compared to other spring materials. (Mischke et al, "Mechanical Engineering Design", $5^{th}$ Edition, McGraw Hill(1989).

The bottom ends of the frame members 5 are permanently fastened to the bottom brace 8 by bottom plugs 17 and nuts(not shown) that screw onto the bottom plugs.

Center shaft 10 is slidably and rotatably positioned within the bushing 4 of the top brace and bushing 9 of the bottom brace 8 and is permanently fastened to the center ring 13. The bushings are made of material suitable for reducing friction between the center shaft braces, such as plastic. Also, linear ball bearings can be used for this purpose.

Engagement cups 11 rest on the upper surface of the bottom brace 8. The bottom ends of springs 6 and 7 bear against the engagement cups and are prevented from moving downward thereby. The engagement cups 11 have engagement sleeves 12 thereon.

One embodiment of the engagement means consists of engagement cups 11, center ring 13 and engagement pins 15.

Center ring 13 has engagement sleeves 14 that are connectable to the engagement sleeves 12 of engagement cups 11. The engagement cups and the center ring are connected by positioning the engagement sleeves of each together and inserting engagement pins 15 into the engagement pin holes of each.

The materials used to construct the pogo stick of the invention described herein are readily available and well known in the prior art. Their strength and weight are important factors. The material has to be able to withstand the stress induced by a 250-pound person, while at the same time remaining relatively lightweight to allow use by people of lesser weight. One such material for making the frame members 5 is cro-moly 4130 steel tubing.

The frame members may be solid, but are preferably tubular because the use of tubes will result in a pogo stick of lighter weight.

One embodiment of the pogo stick of this invention was constructed as follows. The engagement cups were made by cutting 1.625" cro-moly tubing just past the length they needed to be. Then 0.125" thick pieces of cro-moly material were cut from a 2" diameter round rod. These pieces were positioned on the bottom of the tubing and welded. It was necessary to preheat the pieces being welded so that the tensile strength of the cro-moly pieces would not be lost. If this was not done, the pieces would cool too quickly after being welded, and they would not retain their original strength. After the pieces were welded, the tube was put into the lathe, and the outer diameter was turned down to 1.625". Then a hole was drilled through the end that was closed up to allow the structure shaft to pass through. Finally, the opposite end of the cup was faced down to a length of 2.750" inches.

The center engagement ring was made by turning a piece of solid cro-moly steel to the correct inner and outer diameter specs. Once this was accomplished, slots were cut into the ring 0.0625" thick. These were machined on a vertical mill so the slots could be positioned exactly 90 degrees from each other.

The engagement sleeves were then made to be welded on the ring and cups. Four were cut to length at 0.750" long for the cups, and three others at 0.700" for the ring. This would allow some clearance between the sleeves for ease of changing settings. Once these were machined, they were welded to the engagement rings and cups. After they were welded, they were hand reamed to be sure the pins would go through the holes.

The tubular frame members were constructed in a manner that would allow the pogo stick to be taken apart once it was made. This makes it easier to fix problems that arise. Therefore, cro-moly bottom plugs 17 were made to fit into the bottom of the frame members. These went into the tubes 1" and then the diameter decreased to 0.375". This 0.375" section was then threaded so locknuts could be put on. The outer diameter of the bottom plugs were turned down to the inner diameter of the tubes and inserted. They were then welded in place, and turned back down to 0.750". The opposite ends of the frame members were "fishmouthed" or rounded using the vertical mill so that the ends would meet up flush with the handlebar, when being welded.

Once the frame members were finished, the top and bottom braces were manufactured. The top brace was made by drilling and reaming each of the frame member holes, as well as the center hole for the bushing. For the bottom brace, the frame member holes were slightly different. The frame member came through the first thickness of the box tubing, which was a 0.750" hole, then would butt against the inside of the other wall thickness. The threaded bottom plug would, however, continue through the material in a 0.375" hole. The center-bushing hole was drilled and reamed the same way the upper brace was done.

The handlebar and center shaft were then made. These had to be cut to length using a bandsaw. Once the center shaft had been cut, the center engagement ring was welded to it in the appropriate location. The structure was then assembled and prepared for welding. The structure was kept square by clamping it to a welding table. To avoid blowouts during welding of tubular frame members, small holes were drilled in the tubes.

Once the structure was welded, the bushings were pressed into the top and bottom structure. This was done after the welding process so the heat from the welding would not deform them. The springs were then installed, and some initial testing was performed to ensure the pogo stick was working correctly. The structure was then painted, and the additional components were installed on the pogo stick. These components consisted of hand grips, endcaps, a dampening tip, and safety sleeves. The safety sleeves were attached by drilling pilot holes into the upper and lower braces, then attaching them with screws. Grip tape (Not shown) was placed on the top of the bottom brace to prevent users from slipping.

Spring constants can be calculated utilizing the following formula, $$K = \frac{d^4 G}{8D^3 N}$$

Wherein k=spring constant, d=diameter of the spring wire, G=shear modulus of the material, D=outer diameter of spring (center to center of wire) and N=number of coils (Warrendale, P. A., "Design and Application of Helical and Spiral Springs", Society of Automotive Engineers, 1982).

Because of the high working stress of the springs, they should be manufactured in a manner that will minimize strain in their material. Such methods of manufacture are known in the prior art. While the free length of the spring may vary, a free length of 16.5 inches allowed for a spring displacement of about 7.5 inches.

In one embodiment of the invention described herein, the spring rates were 43 pounds/inch for the first setting and 73 pounds/inch for the second setting. When both springs were engaged, the combined spring rate was 116 pounds/inch. The first setting allowed for weights ranging from 80 to 137 pounds, the second allowed for weights ranging from 138 to 195 pounds and when both springs were engaged, weights ranging from 196 to 253 pounds were allowed.

While a preferred combination of springs will accommodate persons weighing about 80 to about 250 pounds, pogo sticks utilizing the concepts of the invention described herein can be designed to accommodate persons weighing below 80 pounds and above 250 pounds. Also, more than two springs having different spring rates can be used in accordance with the teachings herein described.

The embodiment of the invention described above are to be regarded as being merely illustrative and not restrictive. Accordingly, the present invention may be embodied in other specific forms without deviating from the spirit thereof. The present invention is therefore to be limited only by the scope of the following appended claims.

What is claimed is:

1. An adjustable spring rate pogo stick comprising:

a) a top brace;

b) a single handle;

c) a bottom brace;

d) frame members that are fastened to the handle and to the top and bottom braces;

e) an elastic member that consists of multiple compression springs having different spring rates and that slidably surround the frame members and are compressible between the top brace and the bottom brace;

f) a single center shaft that is centered between and parallel to the frame members and is in slidable relationship to said top and bottom braces; and g) engagement means that communicate with the end of the springs nearest the bottom brace and that selectively allows only one or more of the multiple compression springs to be compressed simultaneously, thereby providing three or more different spring settings.

2. An adjustable spring rate pogo stick according to claim 1, wherein said engagement means selectively allows only one or the other springs or both of them to be compressed simultaneously, thereby providing three different spring settings.

3. A pogo stick according to claim 2, wherein the engagement means includes a center ring that is permanently fastened to the center shaft, the center ring has an engagement pin receiving means; engagement cups that are in contact with the bottom of the springs each engagement cup having a pin receiving means; and an engagement pin means.

4. A pogo stick according to claim 3, wherein the pin receiving means on the center ring and the engagement cups are engagement sleeves.

5. A pogo stick according to claim 2, wherein the frame members are made of tubular material.

6. A pogo stick according to claim 2, wherein the frame members are made of non-tubular material.

7. A pogo stick according to claim 2, wherein a dampening tip is attached to the center shaft.

8. A pogo stick according to claim 2, wherein the spring rate of the first spring is 43 pounds/inch, the spring rate of the second spring is 73 pounds/inch and the combined spring rate of the first and second spring is 116 pounds/inch.

9. A pogo stick according to claim 2, wherein safety sleeves are attached to top and bottom braces.

* * * * *